United States Patent [19]

Sutherland

[11] Patent Number: 4,615,524

[45] Date of Patent: Oct. 7, 1986

[54] ADJUSTABLE BARBELL EXERCISE RACK

[75] Inventor: James W. Sutherland, Hastings, Mich.

[73] Assignees: P. Wilcox; D. Soden; T. Barnes, all of Marion, Iowa

[21] Appl. No.: 525,128

[22] Filed: Aug. 22, 1983

[51] Int. Cl.[4] ..... A63B 13/00

[52] U.S. Cl. ..... 272/123; 272/134; 272/DIG. 4; 254/2 B; 269/296

[58] Field of Search ..... 272/93, 123, 134, DIG 4, 272/117; 248/554, 659, 671, 67.7, 73, 129, 422, 424; 254/2 B; 280/47.28; 269/296, 900, 902, 43, 17

[56] References Cited

U.S. PATENT DOCUMENTS

| | | | |
|---|---|---|---|
| 1,325,157 | 12/1919 | Kelley et al. | 248/129 X |
| 1,350,119 | 8/1920 | Staley | 269/296 X |
| 2,805,839 | 9/1957 | Branick | 254/2 B X |
| 2,814,099 | 11/1957 | Knittel | 269/296 X |
| 2,909,358 | 10/1959 | Southerwick | 254/2 B |
| 3,118,668 | 1/1964 | Callahan | 272/123 |
| 4,249,726 | 2/1981 | Faust | 272/123 |
| 4,306,715 | 12/1981 | Sutherland | 272/117 |
| 4,423,865 | 1/1984 | Mahnke | 272/123 |
| 4,477,074 | 10/1984 | Bushnell | 272/123 |

*Primary Examiner*—Richard J. Apley
*Assistant Examiner*—Robert W. Bahr
*Attorney, Agent, or Firm*—Price, Heneveld, Huizenga & Cooper

[57] ABSTRACT

A barbell exercise rack that includes a support base with a support stand upstanding therefrom to which are secured a pair of cantilever support arms. Each arm has a rack which holds the barbell while allowing the barbell to be lifted therefrom. The cantilever arms are mounted so that the outer ends are adjustable to be selectively converged and diverged in order to adjust the racks to various weight lifters. Preferably the height of the cantilever arms is also adjustable while the stand may include either one or two upright support elements.

16 Claims, 8 Drawing Figures

ADJUSTABLE BARBELL EXERCISE RACK

BACKGROUND OF THE INVENTION

The present invention relates to barbell racks, and in particular to adjustable barbell racks, such as are used for squat lift exercises.

Weight lifters perform a variety of exercises in order to develop various different muscles associated with each exercise. One type of exercise involves the weight lifter squatting down in order to position himself under a barbell, and lifting the weight on his shoulders. Such exercises develop the leg and back muscles in particular, and are normally performed with the barbell initially resting upon a supporting exercise rack. The exercise rack holds the barbell on two, laterally spaced apart racks while the weight lifter positions himself between these racks in order to lift the barbell. The adjustment of the exercise rack is dependent upon the particular type of exercise to be performed, and the physique of the particular weight lifter. The two support racks may be required to be shifted laterally so that the weight lifter may vary the placement of his hands upon the supported barbell. It may also be necessary to vary the height of the initial position of the barbell in order to accommodate weight lifters of different heights, or to permit different exercises to be performed.

Problems encountered with the adjustment of such exercise racks are particularly troublesome during competitive events. During such events, numerous weight lifters make use of the same exercise rack, and delays in adjusting the rack slow down the competition. These delays have a deleterious effect upon the spectator appeal of the sport. Further, during many competitive events, a weight lifter has only a fixed amount of time in which to commence a lift, and therefore has a very limited amount of time in which to alter the rack position, if at all. During such competitive events proper rack adjustment has a psychological effect upon some weight lifters' performance, as well as actually physically effecting the weight lifter's ability. Therefore, an exercise rack that is quickly and accurately adjustable is highly desirable.

Heretofore, most exercise racks have made use of two separate stands as a pair of vertical supports, each of which includes a cradle or rack to hold the barbell. The stands must be separately positioned, and usually include a weighted base that prevents the rack from tipping over. Although the weighted base is necessary for the stability of the rack, the weighted base also makes it difficult to change the spacing of the barbell supporting cradles. Normally, the barbell supported by the racks must be manually removed prior to adjustment of the cradle spacing, thereby further delaying the competition.

Exercise racks of the type described above usually include some mechanism for adjusting the height of the cradles, and thus the height of the supported barbell. Often these height adjustment devices must be independently adjusted in order to adjust the height of each individual vertical support. Many existing vertically adjustable exercise racks include telescoping vertical supports that must be manually lifted. Therefore, such exercise racks require that the supported barbell be removed prior to adjustment, the racks be individually adjusted by hand and then the barbell replaced on the racks. All of these separate adjustment activities reduce the speed and ease of rack adjustment. In one existing exercise rack, two vertical supports are each provided with a manual jack for raising the rack height, which is similar to those used with automobiles. Although this rack is an improvement over racks which must be manually lifted, with this exercise rack, two people are still required to simultaneously jack up the cradles if the barbell was not removed prior to adjustment to make sure that the barbell does not slide off of the racks.

SUMMARY OF THE INVENTION

The present invention is embodied in a barbell exercise rack that includes a support base with an upstanding, generally vertical support stand. A pair of support arms, which each have racks at their outer ends, are connected in cantilever fashion to the support stand. The arms are spaced apart, and are laterally adjustable in order to accommodate the different gripping techniques of various weight lifters when they position themselves between the racks at the outer ends of the cantilever arms. Preferably, the arms are also simultaneously vertically adjustable to facilitate weight lifters of all different heights.

In another aspect of the invention, the support base includes a pair of uprights, each of which have a rack connected therewith that supports the barbell. The uprights are adjustably interlinked in order to adjust the spacing of the racks and the adjustment mechanism is located within the support base so that the area above the base between the uprights is substantially unobstructed, such that the weight lifter will not injure himself in the event that he is overcome by the weight of the barbell.

With the device of the present invention, the exercise rack can be quickly and easily adjusted to accommodate various weight lifters. The arms can be simultaneously laterally adjusted while the barbell remains on the device so that the weight lifter may himself make the adjustment. Similarly, the height of the barbell rack can be adjusted while the barbell remains supported thereon so that the height can be instantly adjusted as the weight lifter requires. The present invention therefore permits last minute adjustments to be made by the weight lifter during competition. Since the arms are cantilevered, the barbell is held away from the support stand so that interference with the weight lifter by the remainder of the exercise rack is avoided, both while positioning himself and while lifting the weight.

These and other features, advantages, and objects of the present invention will be further understood and appreciated by those skilled in the art by reference to the following written specification, claims, and appended drawings.

DETAILED DESCRIPTION OF THE PREFERRED EMBODIMENTS

Figure 1:
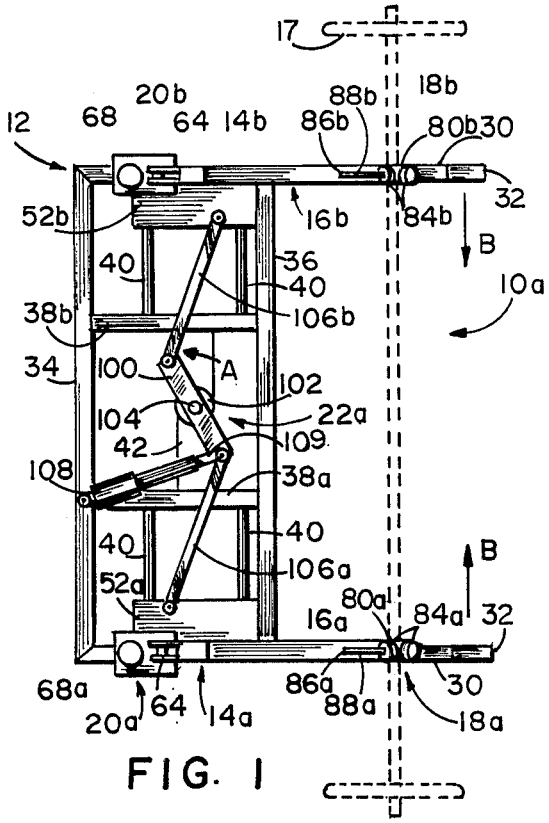
FIG. 1 is a top, plan view of a barbell exercise rack embodying the present invention.

In the preferred embodiments, shown in FIGS. 1–8, a barbell exercise rack 10 includes a support base 12 from which extends a generally upright support stand 14. A pair of cantilever arms 16 extend from support stand 14 and are laterally spaced sufficiently so that a weight lifter may position himself between arms 16 while lifting a barbell 17 supported by arms 16. Located at the free ends of arms 16 are barbell racks 18, which support the barbell 17 but which permit the weight lifter to remove the barbell weight 17. A vertical adjustment mechanism 20 provides a means by which the height of cantilever arms 16 may be adjusted and a horizontal adjustment mechanism 22 provides a means by which the lateral spacing between cantilever arms 16 may be adjusted. The barbell exercise rack 10 may therefore be adjusted to accommodate various weight lifters and to permit a variety of weight lifting grips.

EMBODIMENT OF FIGS. 1–3

Figure 2:
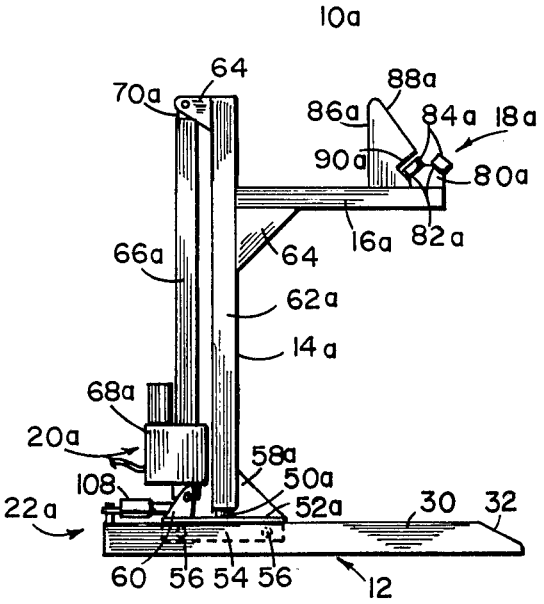
FIG. 2 is a side elevational view of the exercise rack of FIG. 1.
Figure 3:
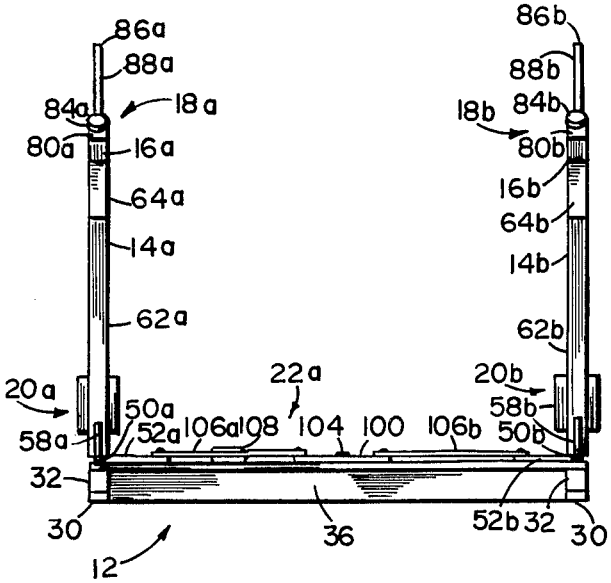
FIG. 3 is a front elevational view of the exercise rack of FIG. 1.

In the embodiment shown in FIGS. 1–3, barbell exercise rack 10*a* includes support base 12 that has a pair of laterally spaced, parallel legs or floor runners 30 that lie flat on the floor surface. Runners 30 are rectangular bars having partially tapered front ends 32. Runners 30 are spaced sufficiently that a weight lifter can stand therebetween in a variety of weight lifting stances without interference from runners 30. The rear ends of runners 30 are rigidly joined by cross bar 34, FIG. 1, which also lies on the floor surface. Intermediate cross bar 34 and tapered ends 32 is another cross bar 36 that rigidly joins runners 30 and also rests on the floor surface. Joining cross bars 34 and 36 are two brackets or braces 38 that divide the area between cross bars 34 and 36 into three quadrants, the two outer quadrants being the same size and slightly smaller than the middle quadrant. Extending parallel to cross bars 34 and 36 between each floor runner 30 and the adjacent bracket 38 are a pair of guide rods 40, each having a circular cross sectional area. Guide rods 40 are used with horizontal adjustment mechanism 22 in order to adjust the spacing of barbell racks 18. Spanning between brackets 38 is an elongated, rectangular pivot support plate 42 which is also used with guide rods 40 to horizontally adjust barbell racks 18 as explained in detail below. Floor runners 30, cross bars 34 and 36, and brackets 38 are all made of one and a half by three inch, eleven gauge rectangular tubing sections which are welded together. Guide rods 40 are each a hardened steel rod one inch in diameter.

As shown in FIGS. 1 and 3, exercise rack 10*a* includes two separate support stands 14*a* and 14*b*, each associated with a separate cantilever arm 16*a* and 16*b*, respectively. As the two support stand-cantilever arm assemblies are identical mirror images of each other, a single description of support stand-cantilever arm assembly 14, 16 is set forth below.

As shown in FIG. 2, support stand 14 includes a rectangular post 50 that extends as a vertical upright from a rectangular slide plate 52. Depending from the underside of slide plate 52 is a track guide 54 that includes two spaced, circular channels 56 which slidably receive guide rods 40. Track guide 54 allows slide plate 52 to slide along guide rods 40 in order to adjust the lateral spacing of cantilever arm 16. As shown in FIG. 3, slide plate 52 is raised slightly above and overhangs the adjacent floor runner 30 in order to position post 50 over runner 30 when slid fully outward. Welded between the front side of post 50 and slide plate 52 is a triangular gusset 58 which rigidly reinforces post 50 in a vertical orientation. Welded to slide plate 52 behind post 50 is a motor mount bracket 60, FIG. 2, which is used in the mounting of vertical adjustment mechanism 20.

Telescopingly received over post 50 is a square upright tube 62. The channel within hollow tube 62 is sufficiently large to allow tube 62 to freely slide along post 50, but which maintains tube 62 generally parallel to post 50 without excessive play. On the front lower end of tube 62 is a rectangular slot through which gusset 58 passes in order to permit tube 62 to be lowered to a position raised slightly out of contact with slide plate 52. Extending to the rear, FIG. 3, at the upper end of tube 62 is a motor bracket 64 that corresponds to lower motor bracket 60. Vertical adjustment mechanism 20 is mounted between brackets 64 and 60.

Vertical adjustment mechanism 20, FIG. 2, includes an electrically operated mechanical jack 66 that is powered by an electrical motor and gear reducer 68. Though the jack may be any of a variety of known jacks, one such suitable jack as depicted in FIG. 2 is manufactured by the DuffNorton Company, Charlotte, NC and sold under the tradename "SUPER-PAC ELECTROMECHANICAL ACTUATOR".

Jack 66 is of conventional design and includes a rod 70, that is slidable within casing 66 and carries at its lower end a nut (not shown) that engages an internally threaded sleeve (not shown) which is driven through gearing by electrical motor 68. Motor 68 is controlled in a conventional manner by a suitable switch mechanism that may be operated by the weight lifter as is conventionally known to those skilled in the art. Vertical adjustment mechanism 20 therefore is operated in order to telescopingly raise or lower tube 62 on post 50 and to rigidly hold tube 62 at the desired height.

Cantilever arm 16 is connected to the front, upper portion of tube 62 so as to extend in a cantilever fashion therefrom, FIG. 2. Welded between the underside of arm 16 and tube 62 is a gusset 64 that rigidly maintains arm 16 in a horizontal orientation. Arm 16 is otherwise unsupported along its length so that barbell rack 18 located on the outer ends of arm 16 are wholly supported in cantilever fashion and are freely accessible to the weight lifter. Both arm 16 and tube 62 are rectangular steel tubular bars two inches by one quarter inch in cross section.

As best shown in FIG. 2, barbell rack 18 is welded onto the upper side at the outer end of arm 16. Rack 18 includes a roller mounting block 80 having two oppositely facing beveled surfaces 82 that each form a 45° angle with the bifurcating plane therebetween. A cylindrical roller 84 is rotatably mounted along its central axis on each beveled surface 82 and are spaced so as to form a supporting surface for the bar or handle of barbell 17 rested upon rack 18. Rollers 84 include suitable bearing surfaces to allow rollers 84 to rotate freely upon mounting block 80. Extending upward from arm 16 immediately to the rear of the rearmost roller 84 is a generally triangular guide plate 86. Guide plate 86 has a top, angled side 88 and a leading edge 90 that are configured to conform to the profile of rearmost roller 84 and mounting block 80. Angled side 88 therefore forms a straight planar guide into the supporting area between rollers 84. Guide plate 86 assists a weight lifter in returning barbell 17 to rack 18 and prevents the barbell from being inadvertently placed on cantilever arm 16.

As shown in FIG. 1, horizontal adjustment mechanism 22*a* is used to converge and separate slide plates 52 in order to adjust the lateral spacing of barbell racks 18. A pivot bar 100 is pivotally mounted by its median point to pivot support bar 42. On pivot support plate 42 is a raised, circular bearing surface 102 that permits pivot bar 100 to pivot about its median point but which maintains pivot bar 100 parallel to the floor surface without excessive wobbling. Pivot bar 100 is mounted by a suitable pivot 104 having bearings which permit bar 100 to turn freely. A left and a right connecting rod 106*a* and 106*b* respectively, are pivotally connected to each slide plate 52 and a separate end of pivot bar 100. Left connecting rod 106*a* is connected to slide plate 52*a* slightly forward of rearmost guide bar 40, while right connecting rod 106*b* is connected to slide plate 52*b* slightly to the rear of forward guide rod 40, causing pivot bar 100 to be slightly out of parallel with crossbars 34 and 36 when slide plates 52 are fully outwardly extended. Connecting rods 106 have suitable bushings to allow rods 106 to freely pivot at both slide plates 52 and pivot bar 100. Slide plates 52 will therefore be positioned equidistant from central pivot 104 as pivot bar 100 is pivoted causing connecting rods 106 to shift slide plates 52. An electrically operated mechanical jack 108 is pivotally connected between cross bar 34 at left bracket 38*a* and the left end of pivot bar 100. Jack 108 includes telescoping rod 109 and is pivotally connected at both ends so that it may pivot as rod 109 extends and pivot bar 100 turns about pivot 104. Jack 108 is similar to jack 66 described above with the exception that jack 108 is of smaller size and horizontally oriented. Jack 108 is controlled by a conventional switch mechanism in conventional fashion, as known by those skilled in the art.

EMBODIMENT OF FIGS. 4–5

Figure 4:
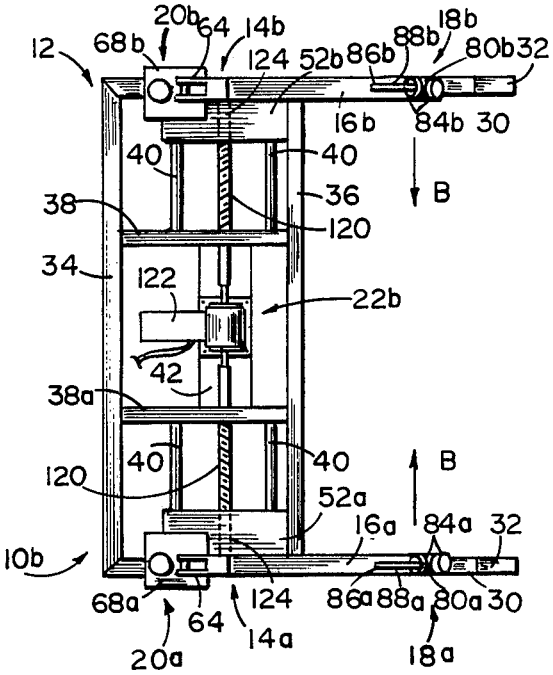
FIG. 4 is a top, plan view of a barbell exercise rack embodying a second embodiment of the present invention.
Figure 5:
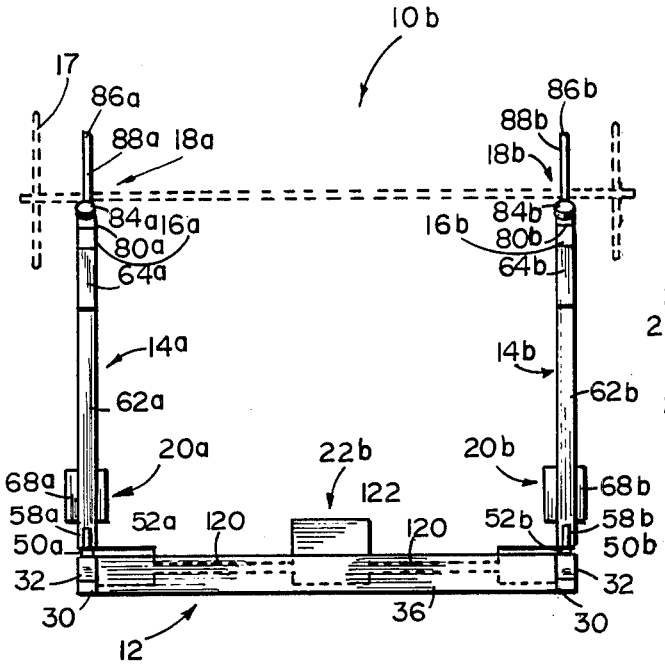
FIG. 5 is a front elevational view of the exercise rack of FIG. 4.

In the embodiment shown in FIGS. 4 and 5, a barbell exercise rack 10*b* is shown similar to that of the embodiment shown in FIGS. 1–3. Barbell exercise rack 10*b* includes a support base 12, support stands 14, cantilever arms 16, barbell racks 18 and vertical adjustment mechanisms 20 identical to those of exercise rack 10*a* shown in FIGS. 1–3. Exercise rack 10*b* differs from exercise rack 10*a* in that a horizontal adjustment mechanism 22*b* is utilized that differs from horizontal adjustment mechanism 22*a*.

As shown in FIGS. 4 and 5, slide plates 52 are shifted by a pair of threaded, rotating screws 120. An electrical motor and gear reducer 122 are mounted on support plate 42 to drive screws 120. Motor 122 is controlled by a suitable switch mechanism of conventional design known to those skilled in the art. Screws 120 extend from opposite ends of motor and gear reducer 122 and are received through a channel through each bracket 38. Screw rods 120 are generally parallel to guide rods 40 and are each threadably received in a threaded channel 124 (FIG. 4) within track guide 54 on the underside of each slide plate 52. As motor 122 is activated, screws 120 are turned so as to simultaneously shift slide plates 52 along guide rods 40.

EMBODIMENT OF FIGS. 6–8

Figure 6:
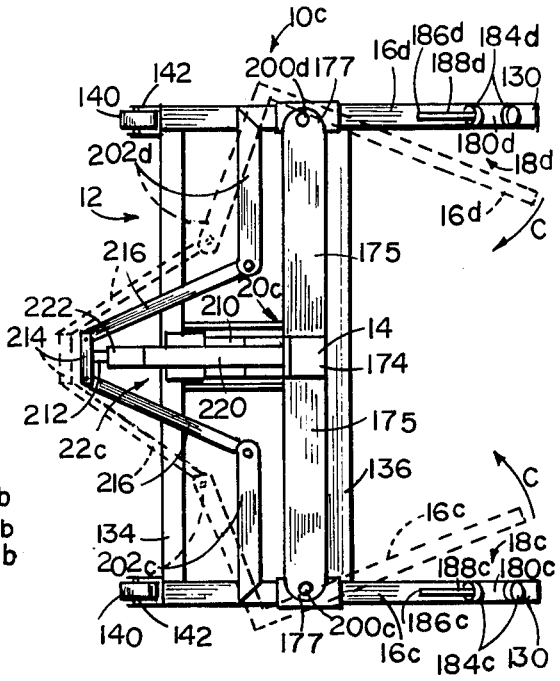
FIG. 6 is a top, plan view of a barbell rack embodying a third embodiment of the present invention, with a laterally adjusted position of the cantilever arms shown in phantom.
Figure 8:
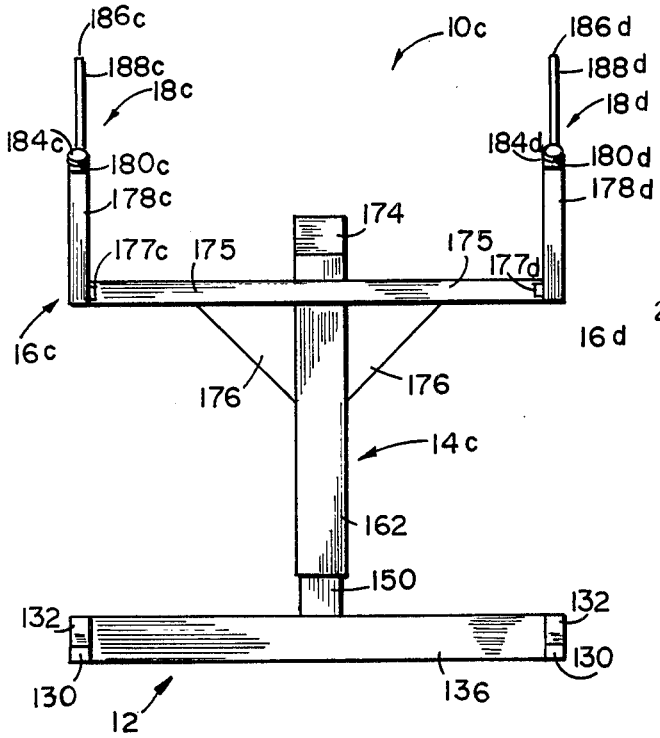
FIG. 8 is a front elevational view of the exercise rack of FIG. 6.
Figure 7:
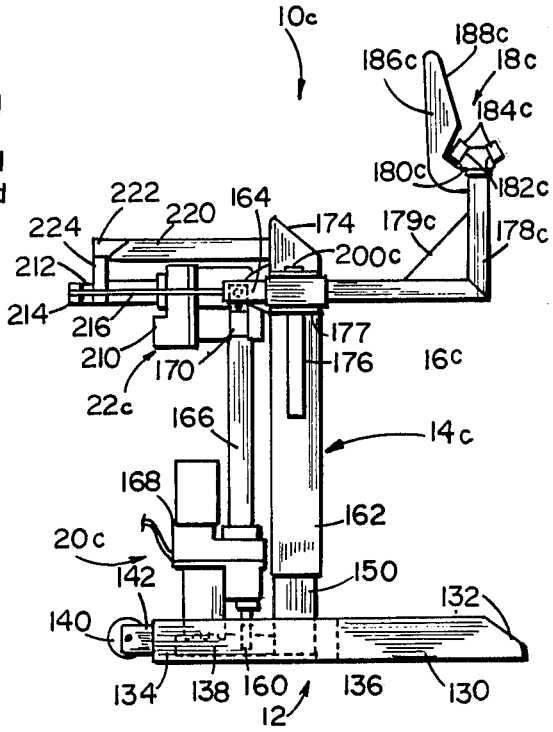
FIG. 7 is a side elevational view of the exercise rack of FIG. 6.

In the embodiment shown in FIGS. 6–8, barbell exercise rack 10*c* is a single post device. Support base 12 includes a pair of laterally spaced floor runners 130 each having a partially tapered front end 132. A joining cross bar 134 (FIG. 6) is welded between the rear ends of floor runners 130 and a cross bar 136 is welded between floor runners 130 intermediate cross bar 134 and tapered front ends 132. As shown in FIG. 7, a bracket 138 is welded intermediate runners 130 so as to extend between cross bar 134 and support stand 14*c*. A pair of wheels 140 are mounted to the rear of opposite ends of cross bar 134 by brackets 142. Wheels 140 are raised a slight distance above the floor surface and are used in the transport of exercise rack 10*c*.

As shown in FIGS. 7 and 8, support stand 14*c* includes a rectangular post 150 that is welded to cross bar 136 so as to stand generally upright at a location intermediate floor runners 130. A motor bracket 160 (FIG. 7) is mounted on bracket 138 that is used in the mounting of vertical adjustment mechanism 20*c*. A rectangular, elongated tube 162 is telescopingly received over rectangular post 150 and includes an internal channel of a size to slide easily along post 150 without excessive play. Extending to the rear of the upper portion of tube 162 is mounting bracket 164 complementary to mounting bracket 160. An electrically operated mechanical jack 166 is mounted between brackets 160 and 164 which may be one of various suitable, conventional types. One such electromechanical jack is described above relative to the double upright embodiment, jack 66. Jack 166 includes a motor and suitable gear reducer 168 as well as an elongated rod 170 which is slidably received within casing 166 so as to be threadably driven by motor 168. Motor 168 includes a suitable switch control mechanism for adjustment of the height of rod 170. The upper end of tube 62 projects above arms 16 and has an upwardly, rearwardly angled surface 174 so that the sharp forward corner of tube 62 is removed.

As shown in FIGS. 6 and 8, extending in cantilever fashion to either side of tube 162 is a cross beam 175. Welded between the underside of each cross beam 175 and tube 162 is a gusset 176, while each cross beam 175 terminates at its outer end with a clevis 177 that is used to pivotally connect cantilever arms 16. Arms 16 extend forward of clevis 177 to pivot in a common horizontal plane. At the outer end of each arm 16 is an upright arm 178 that is reinforced by a gusset 179 (FIG. 7) extending between upright arm 178 and cantilever arm 16.

Connected to the top of each upright arm 178 is a barbell rack 18 used to support barbell 17. Barbell rack 18 includes a block 180 that has an opposed pair of beveled surfaces 182 (FIG. 7) similar to beveled surfaces 82, on which are rotatably mounted a pair of cylindrical rollers 184. A triangular guide plate 186 has an angled top side 188 and a leading edge 190 that are configured to conform to the profile of rearmost roller 184 and to provide a surface that guides the barbell onto the supporting area between rollers 184.

As shown in FIG. 6, cantilever arms 16 are pivotally mounted to clevises 177 at a pair of pivots 200. Cantilever arms 16 are otherwise unsupported along the portion extending forward of pivot 200 so as to avoid any interference with the placement of a weight lifter's hands upon barbell 17. Cantilever arms 16 extend rearward of pivot 200 and each include an inwardly extending arm or flange 202 that gives each arm 16 an overall "L" configuration in plan view. Inward extending arms 202 are used in the converging and separating of barbell racks 18 as described below.

Mounted on the rear of tube 162 at the joint with cross beams 175 is a rearwardly extending electrically operated mechanical jack 210 (FIGS. 6–7). Jack 210 also may be any of a variety of known jacks, such as the type described above for jack 66. Jack 210 has a rod 212 that is joined to a perpendicular joining bracket 214, FIG. 6. A pair of connecting rods 216 are pivotally connected to opposite ends of bracket 214 and are each pivotally connected to the innermost end of one of the inwardly extending arms 202. Connecting rods 216 include suitable bushings at the connection with bracket 214 and inwardly extending arm 202 so that connecting rod 216 may pivot freely at either end. So connected, as rod 212 is extended from jack 210, joining bracket 214 draws connecting rods 216 rearward. Connecting rods 216 pivot in turn and draw rearward the innermost ends of inwardly extending arms 202, causing cantilever arms 16 to pivot at pivots 202 and thus converge barbell racks 18. Mounted on tube 162 above and parallel to jack 210 is a guide tube 220. A guide post 222 is connected to rod 212 by bracket 224 (FIG. 7) and is slidably received within tube 220. Guide tube 220 and sliding post 222 maintain jack 210 and rod 212 in horizontal alignment as jack 210 is activated in order to accurately position barbell racks 18.

OPERATION

Prior to commencing a lift, a weight lifter adjusts barbell racks 18 to the desired position through operation of vertical adjustment mechanism 20 and horizontal adjustment mechanism 22 in order to obtain both the proper height and spacing of barbell racks 18.

In the operation of exercise rack 10*a*, shown in FIGS. 1–3, either vertical adjustment mechanism 20 or horizontal adjustment mechanism 22 may be adjusted independently. In order to adjust the height of racks 18, motors 68 are simultaneously activated by a common switch mechanism (not shown). When activated, motors 68 rotate the threaded shaft within jack casings 66, raising or lowering rods 70 simultaneously. As rods 70 rise, tubes 62 simultaneously rise on posts 50, thereby raising cantilever arms 16 and racks 18. Similarly, when rods 70 are lowered, racks 18 are also lowered. Since telescoping stands 14 are adjusted by the electromechanical actuator, tube 62 is positively, rigidly held in the desired position. Any slippage problems associated with hydraulic or other actuators are avoided. However, a hydraulic actuator or the like could alternatively be used to adjust the height of stands 14 in place of jacks 66, but an electromechanical jack is preferred. An electromechanical jack is particularly preferable when exercise rack 10*a* is to be used to support very large weights and the danger of slippage is thus increased.

In order to adjust the lateral spacing of racks 18, jack 108 is activated. As shown in FIG. 1, slide plates 52 and racks 18 are in a fully outwardly extended position. As jack 108 extends rod 109, pivot bar 100 is pivoted counterclockwise in the direction of arrow A. As pivot bar 100 pivots, its outer ends move away from floor runners 30, causing connecting rods 106 to draw slide plates 52 toward central pivot 104. Slide plates 52 slide along guide rods 40 on track guide 54 causing arms 16 to converge in the direction of arrows B shown in FIG. 1 until racks 18 reach the desired spacing. As racks 18 are adjusted laterally, rollers 84 roll along the length of the supported barbell in order to avoid any skidding or jamming which may be experienced with large weights. It will be noted that as cantilever arms 16 are laterally adjusted, cantilever arms 16 remain parallel throughout.

In order to access the supported barbell 17, the weight lifter aproaches exercise rack 10*a* from the front and positions himself between floor runners 30. Floor runners 30 are sufficiently widely spaced and extend far enough forward of cross bar 36 to accommodate a full range of weight lifting foot placements without interference. The weight lifter grips barbell 17 in the desired manner, and may make last minute adjustments of the placement of racks 18. Racks 18 permit barbell 17 to be lifted freely therefrom, and guide barbell 17 back onto rollers 84 as the barbell is lowered. While barbell 17 is being lowered, if it is held too closely to support stand 14, the barbell will contact guide plates 86 and slide down angled sides 88 until it is firmly seated on rollers 84.

As shown in FIGS. 1–2, floor runners 30 extend farther forward of support stand 14 than do racks 18. The center of gravity of exercise rack 10*a* and the supported barbell 17 will therefore always remain rearward of the tapered front ends 32 of floor runner 30 and prevent exercise rack 10*a* from inadvertently tipping over, even if a great weight is dropped onto racks 18. Thus, additional weights are not required to be added to stand 12 to stabalize exercise rack 10*a*. Additionally, since elongated tube 62 slides over post 50, even if jacks 66 fail, barbell 17 will be prevented from falling onto the weight lifter when tubes 62 contact slide plates 52.

Although jacks 66 are normally operated simultaneously to maintain arms at a common height, jacks 66 may be operated independently in a conventional fashion in order to individually adjust the height of arms 16 under certain circumstances. For instance, if support base 12 is not resting upon a level surface, one support stand 14 could be raised slightly in order to level racks 18.

In the operation of exercise rack 10*b*, shown in FIGS. 4 and 5, racks 18 are adjusted vertically in the same manner as that of exercise rack 10*a*. In order to laterally adjust racks 18, motor 122 is activated and threaded rods 120 are simultaneously rotated. Threaded rods 120 turn in threaded channels 124 within the track guides 54 under slide plates 52, causing slide plates 52 to converge in the direction of arrows B (FIG. 4) or separate as desired. The weight lifter may then access barbell 17 in the same manner as described above.

It will be noted that in both of the embodiments of exercise rack 10*a* and 10*b*, support stands 14 provide a substantially unobstructed area in front of the weight lifter as he faces the rack. In the event that the weight lifter cannot finish his lift and must drop the weight, he may fall forward in order to clear the falling barbell without hindrance from the exercise rack. The dropped barbell 17 will then either fall behind the weight lifter, in front of racks 18, or will land on cantilever arms 16 and be prevented from rolling off by the upper portion of tubes 62 and guide plates 86.

In the operation of exercise rack 10*c*, shown in FIGS. 6–8, the single motor 168 is activated in order to adjust the height of racks 18. Rod 170 is raised or lowered as desired, causing tube 162 to raise or lower on post 150. This in turn adjusts the height of cantilever arms 16 and therefore the height of racks 18 supported thereon.

As shown in FIG. 6, racks 18 are in a laterally, fully separated position with cantilever arms 16 parallel and rod 212 of jack 210 fully retracted. In order to converge racks 18, jack 210 is activated to extend rod 212. As rod 212 and connected joining bracket 214 are extended, connecting rods 216 draw the inner ends of inward arms 202 rearward from cross beams 175 as shown in phantom in FIG. 6. The "L" shaped configuration of arms 16 cause arms 16 to pivot at pivots 200 and thus converge racks 18 in the direction of arrows C (FIG. 6). As rod 170 extends rearward, sliding guide post 222 slides out of guide tube 220 and maintains rod 170 in proper alignment.

Since exercise rack 10*c* is equipped with wheels 140, rack 10*c* may be transported by lifting the front of rack 10*c* in order to tilt the rack back onto wheels 140.

Although exercise rack 10 in its various embodiments as described above and shown in the drawings is dimensioned primarily for the execution of squat lifts, by the elongation or further telescoping of support stand 14 various other weight lifting exercises could be performed with exercise rack 10. If support stand 14 is raised, exercise rack 10 may be used to perform standing military presses, french curls or the like. If support stand 14 is lowered sufficiently, exercise rack may be used to perform standard curls, or combined with a bench to perform bench pressing or the like.

From the foregoing description, it will be readily appreciated by those skilled in the art that modifications or improvements may be made to the embodiments without departing from the spirit of the invention disclosed herein. The scope of the protection provided is to be determined by the claims which follow and the breadth of interpretation which the law allows.

The embodiments of the invention in which an exclusive property or privilege is claimed are as follows:

1. A barbell exercise rack, comprising:

a support base;

a support stand secured to said support base, and upstanding therefrom in a generally vertical orientation;

first and second support arms, having inner and outer ends, and being spaced apart laterally a distance sufficient to accommodate a weight lifter bodily positioned therebetween; said support arms having the inner ends thereof connected with said support stand, extending outwardly therefrom along a generally horizontal orientation, and being wholly supported in a cantilevered fashion by said support stand; the outer ends of said support arms having racks connected therewith adapted for selectively holding and supporting a barbell thereon a spaced apart distance from said support stand, while allowing the barbell to be lifted freely therefrom;

said arms are pivotally mounted to said support stand at associated pivot points, said arms pivoting about respective ones of said pivot points in a generally horizontal plane;

means for mechanically converging and diverging the outer ends of said support arms, and thereby adjusting the lateral position of said racks with respect to the barbell to accommodate various weight lifters; and said converging and diverging means including means for selectively pivoting said arms about said pivot points to converge and diverge said outer ends.

2. The barbell exercise rack of claim 1 wherein said support arms are substantially commensurate in length, and said support base includes a pair of legs extending in the same direction as said support arms, and being spaced laterally apart a distance sufficient to permit a weight lifter to freely ambulate therebetween and access the barbell; said base legs having a length at least as great as the length of said support arms for stability.

3. The barbell exercise rack of claim 2, wherein said support stand includes a single, generally vertically telescoping upright; said upright having a cross bar connected with an upper member of said telescoping upright on which said support arms are pivotally mounted.

4. The barbell rack of claim 3 wherein said racks include rollers on which the barbell is supported to facilitate lateral adjustment of said support arms without removing the barbell from said racks.

5. The barbell exercise rack of claim 4, wherein said support stand includes means for mechanically adjusting the vertical position of said racks.

6. The barbell exercise rack of claim 5, wherein said vertical adjusting means comprises an electrically powered ball and screw motor, whereby the height of said racks is automatically and securely locked into position when said motor is deactivated.

7. A barbell exercise rack, comprising:

a support base, said support base including a laterally extending track with first and second carriages slidably mounted on opposite sides thereof;

a support stand secured to said support base, and upstanding therefrom in a generally vertical orientation;

first and second support arms, having inner and outer ends, and being spaced apart laterally a distance sufficient to accommodate a weight lifter bodily positioned therebetween; said support arms having the inner ends thereof connected with said support stand, extending outwardly therefrom along a generally horizontal orientation, and being wholly supported in a cantilevered fashion by said support stand; the outer ends of said support arms having racks connected therewith adapted for selectively holding and supporting a barbell thereon a spaced apart distance from said support stand, while allowing the barbell to be lifted freely therefrom;

said support stand comprising first and second uprights mounted to and upstanding from said first and second carriages respectively, with said arms being supported on upper ends of said uprights, whereby said support stand supports the barbell on opposite sides thereof, and is open at the front and back to avoid contact with and injure the lifter in the event that he is overcome by the weight of the barbell; and means for mechanically converging and diverging the outer ends of said support arms, and thereby adjusting the lateral position of said racks with respect to the barbell to accommodate various weight lifters.

8. The barbell exercise rack of claim 7 wherein:

said support arms are substantially commensurate in length, and said support base includes a pair of legs spaced laterally apart a distance sufficient to permit a weight lifter to freely ambulate therebetween and access the barbell; said base legs having a length at least as great as the length of said support arms for stability.

9. The barbell exercise rack of claim 8, wherein said racks include rollers on which the barbell is supported to facilitate lateral adjustment of said support arms without removing the barbell from said racks.

10. The barbell exercise rack of claim 9, wherein said support stand includes means for mechanically adjusting the vertical position of said racks.

11. The barbell exercise rack of claim 10, wherein said vertical adjustment means comprises an electrically powered ball and screw motor operably connected to each upright, whereby the height of said jacks is automatically and securely locked into position when said motor is deactivated.

12. A barbell exercise rack, comprising:

a support base, having first and second, laterally spaced apart legs which define an unobstructed floor area therebetween and said base having a joining portion between said legs;

a support stand secured to said support base, and upstanding therefrom in a generally vertical orientation, said support stand including a single telescoping upright element and a means for selectively, adjustably varying the height of said telescoping upright element and said arms therewith;

first and second laterally spaced apart support arms connected with an upper end of said support stand in a cantilever fashion and extending outward therefrom in a generally horizontal orientation;

said support arms each including a rack positioned adjacent to the free end of the associated support arm adapted for selectively holding and supporting a barbell, while allowing the barbell to be freely lifted therefrom, said arms being laterally adjustable so as to converge and diverge said racks;

said racks being disposed in a common vertical plane, and said legs each including a generally horizontally oriented floor runner extending from said joining portion, said floor runners extending from said joining portion a distance greater than the distance said vertical plane is spaced from said joining portion;

said support arms being spaced laterally apart a distance sufficient to permit a weight lifter to freely ambulate therebetween into the unobstructed floor area and access the barbell; and means for simultaneously adjusting the height of both of said arms to accommodate an individual weight lifter.

13. The barbell exercise rack of claim 12, wherein said racks include means for rolling along and supporting said barbell while said racks are converged and diverged.

14. A barbell exercise rack, comprising:

a support base, having first and second, laterally spaced apart legs which define an unobstructed floor area therebetween and said base having a joining portion between said legs;

a support stand secured to said support base, and upstanding therefrom in a generally vertical orientation;

first and second laterally spaced apart support arms connected with an upper end of said support stand in a cantilever fashion and extending outward therefrom in a generally horizontal orientation, said support arms being spaced laterally apart a distance sufficient to permit a weight lifter to freely ambulate therebetween into the unobstructed floor area;

said support arms each including a rack positioned adjacent to the free end of the associated support arm adapted for selectively holding and supporting a barbell, while allowing the barbell to be freely lifted therefrom, said racks being disposed in a common vertical plane, and said legs including generally horizontally oriented floor runners extending from said joining portion, said floor runners extending from said joining portion a distance greater than the distance said vertical plane is spaced from said joining portion;

means for simultaneously adjusting the height of both of said arms to accommodate an individual weight lifter, said both arms simultaneous height adjusting means includes said support stand having two spaced telescoping upstanding elements each having a support arm associated therewith, and means for selectively, adjustably varying the height of said telescoping upright elements; and means for selectively, laterally adjusting said racks, said horizontal adjustment means being disposed within said base so that the area between said upright elements above said base is substantially unobstructed.

15. The barbell exercise rack of claim 14, wherein said racks include means for rolling along and supporting a barbell thereon as said racks are separated and converged.

16. A barbell exercise rack, comprising:

a support base which includes a laterally extending track with first and second carriage slidably mounted on opposite sides thereof;

first and second uprights mounted to and upstanding from said first and second carriages respectively;

said uprights each having a rack connected therewith adapted for selectively holding and supporting a barbell thereon, while allowing the barbell to be lifted freely therefrom; and means for simultaneously, selectively converging and diverging said uprights and thereby adjust the lateral position of said racks with respect to the barbell to accommodate various weight lifters, said converging and diverging means interlinking said uprights and being disposed within said base so that the area between said uprights above said base is substantially unobstructed at both the front and the back to permit unobstructed passage of a weight lifter therethrough in the event that he is overcome by the weight of the barbell and must remove himself from beneath the barbell.

* * * * *